United States Patent [19]

Zellweger et al.

[11] 3,969,983

[45] July 20, 1976

[54] BREECHBLOCK FOR AUTOMATIC FIRING WEAPON

[75] Inventors: Jürg Zellweger, Neerach; Max Fierz, Rumlang, both of Switzerland

[73] Assignee: Werkzeugmaschinenfabrik Oerlikon-Buhrle, Zurich, Switzerland

[22] Filed: Sept. 30, 1974

[21] Appl. No.: 510,913

[30] Foreign Application Priority Data

Oct. 3, 1973 Switzerland ..... 14151/73

[52] U.S. Cl. ..... 89/185

[51] Int. Cl.[2] ..... F41D 3/06

[58] Field of Search ..... 89/172, 185

[56] References Cited

UNITED STATES PATENTS 3,507,187 4/1970 Maillard ..... 89/185

3,566,744 3/1971 Stoner ..... 89/172

*Primary Examiner*—Stephen C. Bentley

*Attorney, Agent, or Firm*—Werner W. Kleeman

[57] ABSTRACT

A breechblock or breechblock arrangement for an automatic firing weapon with a breechblock carrier in which there is rotatably and axially displaceably mounted a substantially cylindrical breechblock body, a control bolt arranged transversely with respect to the breechblock body axis and which penetrates through the breechblock body. Each end of the control bolt is surrounded by a sleeve, both of the sleeves are rotatably mounted in a bore of the breechblock body and penetrate into the control grooves of the breechblock carrier, and holding means or elements fastened to the control bolt to secure the sleeves against axial displacement.

3 Claims, 2 Drawing Figures

BREECHBLOCK FOR AUTOMATIC FIRING WEAPON

BACKGROUND OF THE INVENTION

The present invention relates to a new and improved construction of breechblock or breechblock arrangement for an automatic firing weapon with a breechblock carrier or support in which there is rotatably and axially displaceably mounted a substantially cylindrical breechblock body, and further includes a control bolt arranged transversely with respect to the axis of the breechblock body, this control bolt piercingly extending through the breechblock body and with both of its ends engaging in control or cam grooves of the breechblock carrier.

According to a prior art firing weapon of this type the control bolt consists of a sleeve secured to the breechblock body which engages into the control grooves of the breechblock carrier sleeve or breechblock support sleeve and bears against the walls of the grooves. During displacement of the control bolt in the control grooves the same locations of the control bolt always bear against the groove walls, so that flat portions or locations are formed at the control bolt due to plastic deformation or wear.

SUMMARY OF THE INVENTION

Hence it is a primary object of the present invention to provide an improved construction of breechblock for an automatic firing weapon which is not associated with the aforementioned drawbacks and limitations of the prior art constructions.

Another and more specific object of the present invention aims at avoiding such drawback and providing a breechblock wherein the wear of the control bolt is smaller in that the friction does not always arise at the same location.

Now in order to implement these and still further objects of the invention, which will become more readily apparent as the description proceeds, the breechblock of this development is manifested by the features that each end of the control bolt is surrounded by a sleeve, both of the sleeves are rotatably mounted in a bore of the breechblock body and engage into the control grooves of the breechblock carrier or support, and holding means or elements are provided which are fastened to the control bolt and secure the sleeves against axial displacement.

BRIEF DESCRIPTION OF THE DRAWING

The invention will be better understood and objects other than those set forth above, will become apparent when consideration is given to the following detailed description thereof. Such description makes reference to the annexed drawing wherein.

DETAILED DESCRIPTION OF THE PREFERRED EMBODIMENTS

Figure 1:
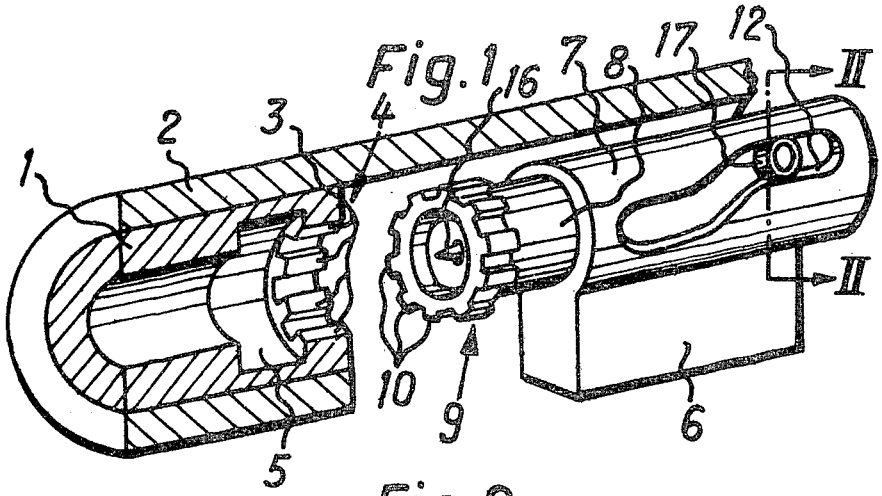
FIG. 1 is a longitudinal sectional view through a breechblock of an automatic firing weapon with unlocked breechblock body in perspective view.

Describing now the drawing, according to the showing of FIG. 1 the weapon barrel or tube 1 is displaceably secured in a sleeve-shaped portion 2 of a not particularly illustrated breechblock housing. The rear end of the weapon barrel 1 possesses a flange 4 which is provided with internal teeth 3. In front of this flange 4 the weapon barrel 1 internally possesses a peripheral groove 5. Behind the weapon barrel 1 there is arranged a breechblock carrier or support 6 at which there is attached a breechblock carrier sleeve 7. In this breechblock carrier sleeve 7 there is rotatably mounted a substantially cylindrical breechblock body 8. This breechblock body 8 possesses at its front end a flange 9 which is equipped with external teeth 10. The gaps between the teeth 3 of the flange 4 are designed such that the teeth 10 of the flange 9 can be introduced through these gaps. As soon as the flange 9 is located in the groove 5 of the weapon barrel 1 then the breechblock body 8 can be rotated by one tooth division. The teeth 10 of the flange 9 at the breechblock body 8 are then located in front of the teeth 3 of the flange 4 at the weapon barrel 1, so that the breechblock body 8 is locked in the weapon barrel 1. For rotating the breechblock body 8 in the breechblock carrier sleeve 7 there is secured a control bolt 11 at the breechblock body 8. This control bolt 11 extends with both of its ends into helical- or thread-like control grooves 12 of the breechblock carrier sleeve 7. Of these two control grooves 12 there has only been shown one such groove in FIG. 1.

Figure 2:
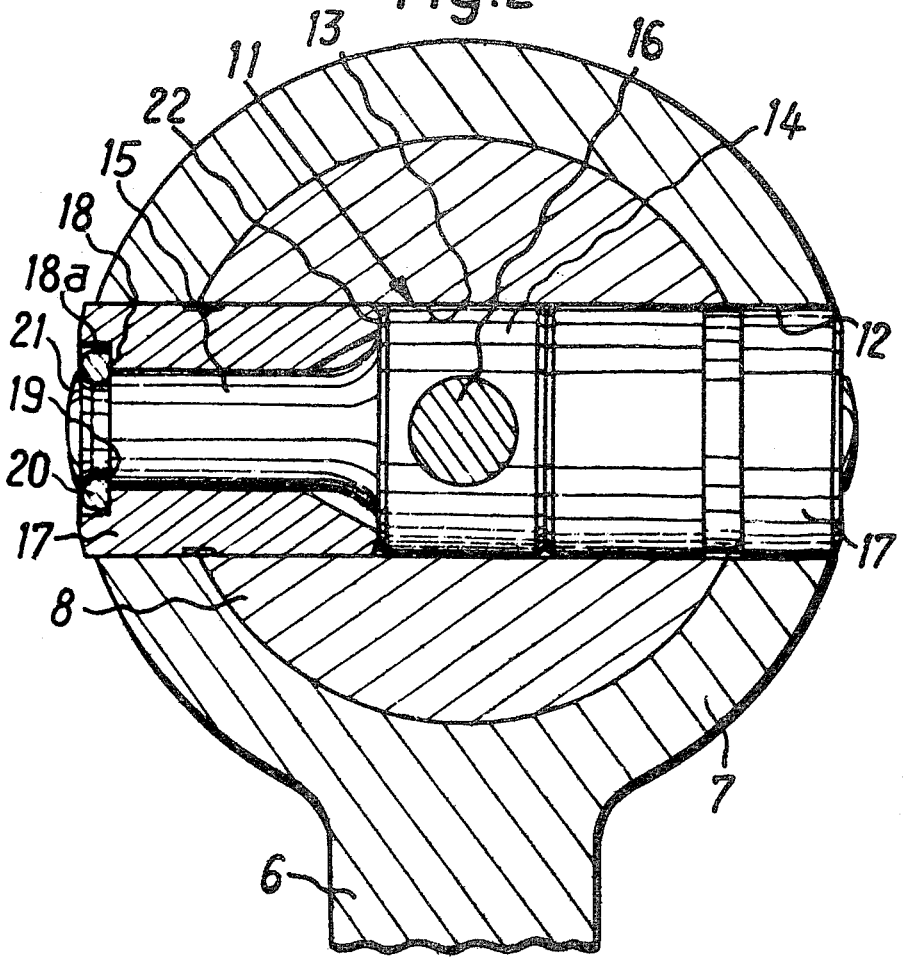
FIG. 2 is a cross-sectional view of the arrangement of FIG. 1, taken substantially along the line II—II thereof.

According to the showing of FIG. 2 the breechblock body 8 possesses a continuous bore 13, the axis of which is directed transverse to the lengthwise axis of the cylindrical breechblock body 8 and intersects such lengthwise axis. The control bolt 11 possesses a central or intermediate portion 14 and two projections 15 which are coaxially arranged with respect thereto and of smaller diameter. The intermediate portion 14 is penetrated by a firing pin 16 which in not particularly illustrated manner is attached to the breechblock carrier sleeve 7. At each end the projections 15 of the control bolt 11 there is located a sleeve 17. The outer diameter of the sleeves 17 and the intermediate portion 14 of the control bolt 11 is the same size as the diameter of the bore 13. The sleeves 17 are seated with play at the projections 15 and possess at their outer end surfaces turned-in or stepped portions 18a having shoulders 18. The projections 15 possess grooves with shoulders 19. A ring or ring member 20 is pressed by a rivet head 21 against the shoulder 19. The sleeves 17 possess between the shoulders 22 of the portion 14 of the control bolt 11 and the ring 20 an axial play and are rotatably mounted in the bore 13. The sleeves 17 at the control bolt 11 extend into the helical-shaped grooves 12 of the breechblock carrier sleeve 7. A displacement of the breechblock body 8 in the breechblock carrier sleeve brings about at the same time a rotation of the breechblock body 8.

The mode of operation of the described apparatus is as follows:

At the moment of ignition or firing of a cartridge or ammunition located in the barrel 1 the breechblock carrier 6 is located in its forwardmost position in which the breechblock body 8 is locked with the weapon barrel 1. The control bolt 11 therefore is located at the rear end of the helical-shaped control groove 12. Owing to the gas pressure the breechblock carrier 6 is displaced in conventional manner towards the rear and specifically initially by the retracting weapon barrel 1 and subsequently by a not particularly illustrated plunger, whereby the breechblock carrier 6 carries out a relative movement with respect to the breechblock body 8. The control bolt 11 is displaced in the helical-shaped control groove 12 and the breechblock body 8 rotates in the breechblock carrier sleeve 7 and there is released the locking action between the breechblock body 8 and the weapon barrel 1, so that also the breechblock body 8 can move back.

During the relative movement of the breechblock body 8 with respect to the breechblock carrier sleeve 7 the sleeves 17 of the control bolt 11 rotate, so that these sleeves 17 roll upon the walls of the control grooves.

The locking action occurs in reverse manner. The relative movement between the breechblock body 8 and the breechblock carrier 6 occurs initially when the breechblock body has reached its forwardmost position and the teeth 10 of the breechblock body 8 are located in the peripheral groove 5 of the weapon barrel 1.

While there is shown and described present preferred embodiments of the invention, it is to be distinctly understood that the invention is not limited thereto, but may be otherwise variously embodied and practiced within the scope of the following claims, Accordingly,

What is claimed is:

1. A breechblock arrangement for an automatic firing weapon comprising a breechblock carrier, a substantially cylindrical breechblock body rotatably and axially displaceably mounted in said breechblock carrier, said breechblock body having a transversely extending bore, a control bolt arranged in said transversely extending bore of said breechblock body, said breechblock carrier being provided with control grooves, said control bolt having opposed ends, a sleeve surrounding each end of the control bolt, said sleeves being rotatably mounted in said bore of the breechblock body and engaging with the control grooves of the breechblock carrier, and holding means fastened to the control bolt for securing the sleeves against axial displacement.

2. The breechblock arrangement as defined in claim 1, wherein said holding means is fastened to each end of the control bolt and comprises at each end of the control bolt a ring located in a stepped portion having a shoulder of the associated sleeve and bearing against the shoulder of such stepped portion and a rivet head at the associated end of the control bolt.

3. A breech mechanism for an automatic firing weapon comprising a breechblock carrier provided with control grooves, a breechblock body having a lengthwise extending axis, said breechblock carrier and breechblock body being structured for mounting said breechblock body to be rotatable and axially displaceable in said breechblock carrier, said breechblock body having a bore extending transversely with respect to said lengthwise axis, a control bolt arranged in said transversely extending bore of said breechblock body, said control bolt having opposed ends, a sleeve surrounding each end of the control bolt and seated with play thereon, each of said sleeves extending axially of said control bolt and taking-up bending loads to prevent any appreciable bending load from being applied to said control bolt, said sleeves being rotatably mounted in said transversely extending bore of the breechblock body and engaging with the control grooves of the breechblock carrier, and means for securing the sleeves against axial displacement.

* * * * *